US009632472B2

(12) United States Patent
Mori et al.

(10) Patent No.: US 9,632,472 B2
(45) Date of Patent: Apr. 25, 2017

(54) SUPPORT MEMBER, IMAGE CARRIER, AND IMAGE FORMING APPARATUS

(71) Applicant: FUJI XEROX CO., LTD., Tokyo (JP)

(72) Inventors: Masahiro Mori, Yokohama (JP); Hiroshi No, Ebina (JP); Shinya Makiura, Ebina (JP); Shuhei Yamazaki, Ebina (JP); Kazushi Arake, Ebina (JP); Satoshi Hayasaka, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/993,354

(22) Filed: Jan. 12, 2016

(65) Prior Publication Data

US 2017/0003638 A1 Jan. 5, 2017

(30) Foreign Application Priority Data

Jun. 30, 2015 (JP) ..... 2015-131176

(51) Int. Cl.
*G03G 15/00* (2006.01)

(52) U.S. Cl.
CPC ..... *G03G 15/751* (2013.01)

(58) Field of Classification Search
CPC ..... G03G 15/75; G03G 15/751; G03G 2215/00953
See application file for complete search history.

(56) References Cited

U.S. PATENT DOCUMENTS 6,131,003 A * 10/2000 Cais ..... G03G 15/751 399/159
6,296,979 B1 * 10/2001 Morita ..... G03G 5/10 399/16
6,438,338 B1 * 8/2002 Mark ..... G03G 15/751 399/159
6,754,462 B2 * 6/2004 Fujishiro ..... G03G 15/751 399/159
2001/0012458 A1 * 8/2001 Fritz ..... G03G 15/751 399/91
2002/0141781 A1 * 10/2002 Litman ..... G03G 15/751 399/159
2002/0186985 A1 * 12/2002 Fujishiro ..... G03G 15/751 399/91

(Continued)

FOREIGN PATENT DOCUMENTS

JP H08-54804 A 2/1996

OTHER PUBLICATIONS

Jan. 26, 2017 Office Action issued in Japanese Patent Application No. 2015-246599.

*Primary Examiner* — David Gray
*Assistant Examiner* — Carla Therrien
(74) *Attorney, Agent, or Firm* — Oliff PLC

(57) ABSTRACT

A support member is supported in a cylinder included in an image carrier and includes a separation-space-defining portion that is arranged at a certain position in a circumferential direction and extends in an axial direction of the cylinder so that the support member has an arc shape; and a groove-defining portion having a groove depth that changes along the axial direction. A bottom plate of the groove-defining portion is elastically deformed so that the support member presses an inner peripheral surface of the cylinder at least at both ends in the axial direction and is thereby supported in the cylinder.

9 Claims, 10 Drawing Sheets

(56) References Cited

U.S. PATENT DOCUMENTS

| | | | | |
|---|---|---|---|---|
| 2015/0078783 | A1* | 3/2015 | Iikura | G03G 15/751 399/159 |
| 2015/0370212 | A1* | 12/2015 | Iikura | G03G 15/751 399/117 |
| 2016/0026143 | A1* | 1/2016 | Ichikawa | G03G 15/75 399/159 |

* cited by examiner

SUPPORT MEMBER, IMAGE CARRIER, AND IMAGE FORMING APPARATUS

CROSS-REFERENCE TO RELATED APPLICATIONS

This application is based on and claims priority under 35 USC 119 from Japanese Patent Application No. 2015-131176 filed Jun. 30, 2015.

BACKGROUND

Technical Field

The present invention relates to a support member, an image carrier, and an image forming apparatus.

SUMMARY

According to an aspect of the invention, there is provided a support member that is supported in a cylinder included in an image carrier and that includes a separation-space-defining portion that is arranged at a certain position in a circumferential direction and extends in an axial direction of the cylinder so that the support member has an arc shape; and a groove-defining portion having a groove depth that changes along the axial direction. A bottom plate of the groove-defining portion is elastically deformed so that the support member presses an inner peripheral surface of the cylinder at least at both ends in the axial direction and is thereby supported in the cylinder.

BRIEF DESCRIPTION OF THE DRAWINGS

Exemplary embodiments of the present invention will be described in detail based on the following figures, wherein.

DETAILED DESCRIPTION

First Exemplary Embodiment

Figure 1B:
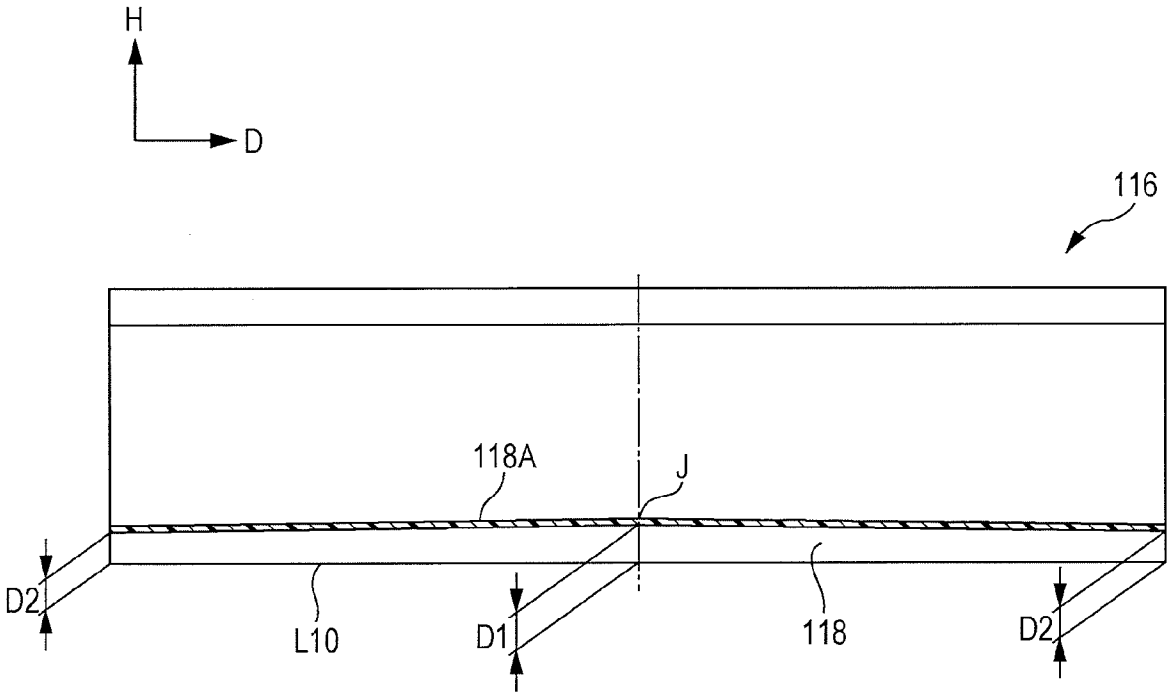
FIG. 1B is a sectional view taken along line IIB-IIB in FIG. 1A.

Examples of a support member, an image carrier, and an image forming apparatus according to a first exemplary embodiment of the present invention will be described with reference to FIGS. 1A to 7. In the drawings, the arrow H shows the up-down direction of the apparatus (vertical direction), the arrow W shows the width direction of the apparatus (horizontal direction), and the arrow D shows the depth direction of the apparatus (horizontal direction).

Overall Structure

Figure 6:
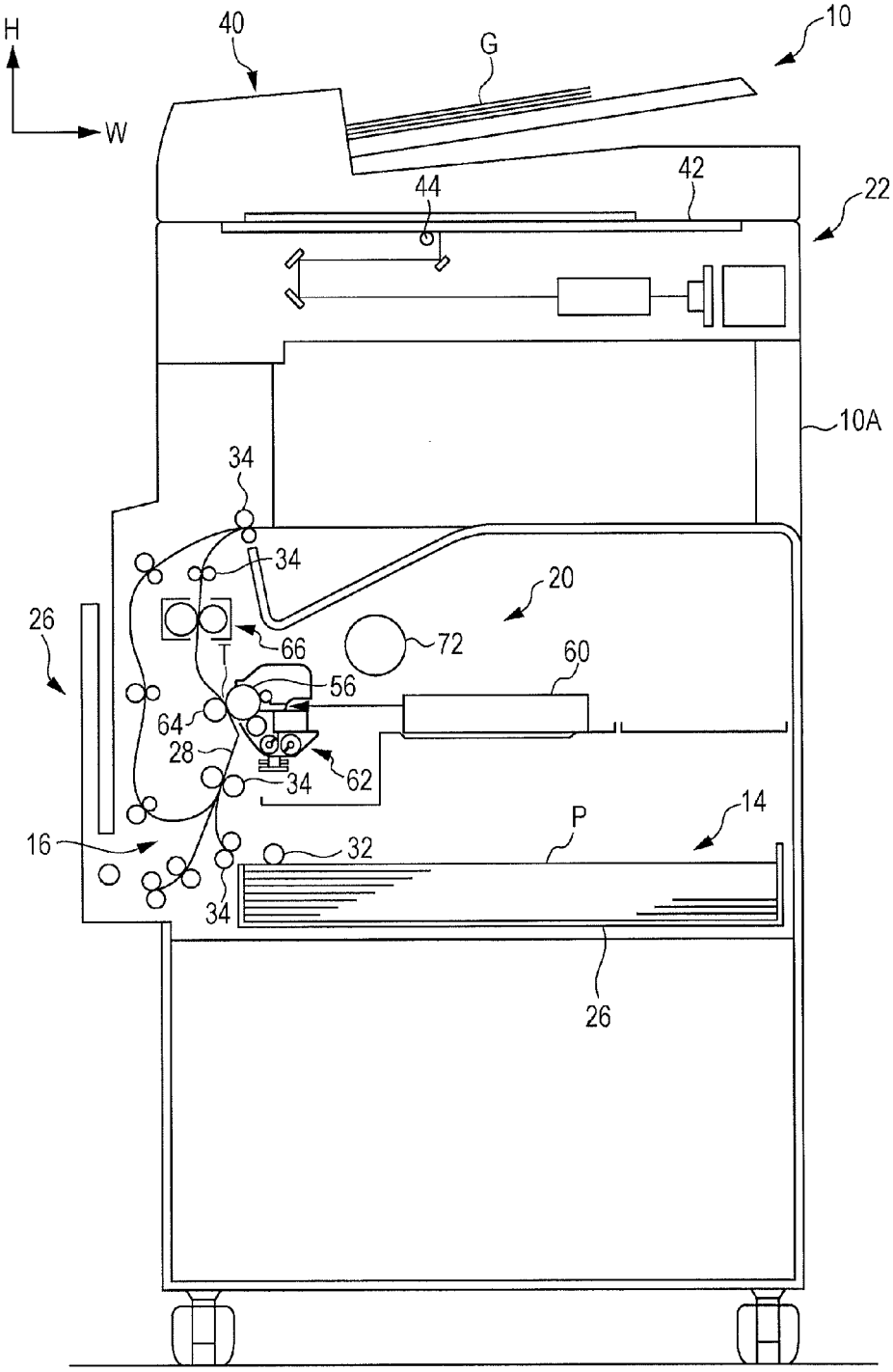
FIG. 6 is a schematic diagram illustrating the structure of the image forming apparatus according to the first exemplary embodiment of the present invention.

As illustrated in FIG. 6, an image forming apparatus 10 according to the present exemplary embodiment includes a container unit 14, a transport unit 16, an image forming unit 20, and a document reading unit 22, which are arranged in that order from the bottom to top in the up-down direction (direction of arrow H). The container unit 14 contains sheet materials P, which serve as recording media. The transport unit 16 transports the sheet materials P contained in the container unit 14. The image forming unit 20 forms images on the sheet materials P transported from the container unit 14 by the transport unit 16. The document reading unit 22 reads document sheets G.

Container Unit

The container unit 14 includes a container member 26 that may be pulled out from a body 10A of the image forming apparatus 10 toward the front side in the depth direction of the apparatus. The sheet materials P are stacked in the container member 26. The container unit 14 also includes a feed roller 32 that feeds the sheet materials P stacked in the container member 26 to a transport path 28 included in the transport unit 16.

Transport Unit

The transport unit 16 includes plural transport rollers 34 that transport sheet materials P along the transport path 28.

Document Reading Unit

The document reading unit 22 includes a light source 44 that emits light toward a document sheet G that has been transported by an automatic document transport device 40 or placed on a platen glass 42.

Image Forming Unit

Figure 5:
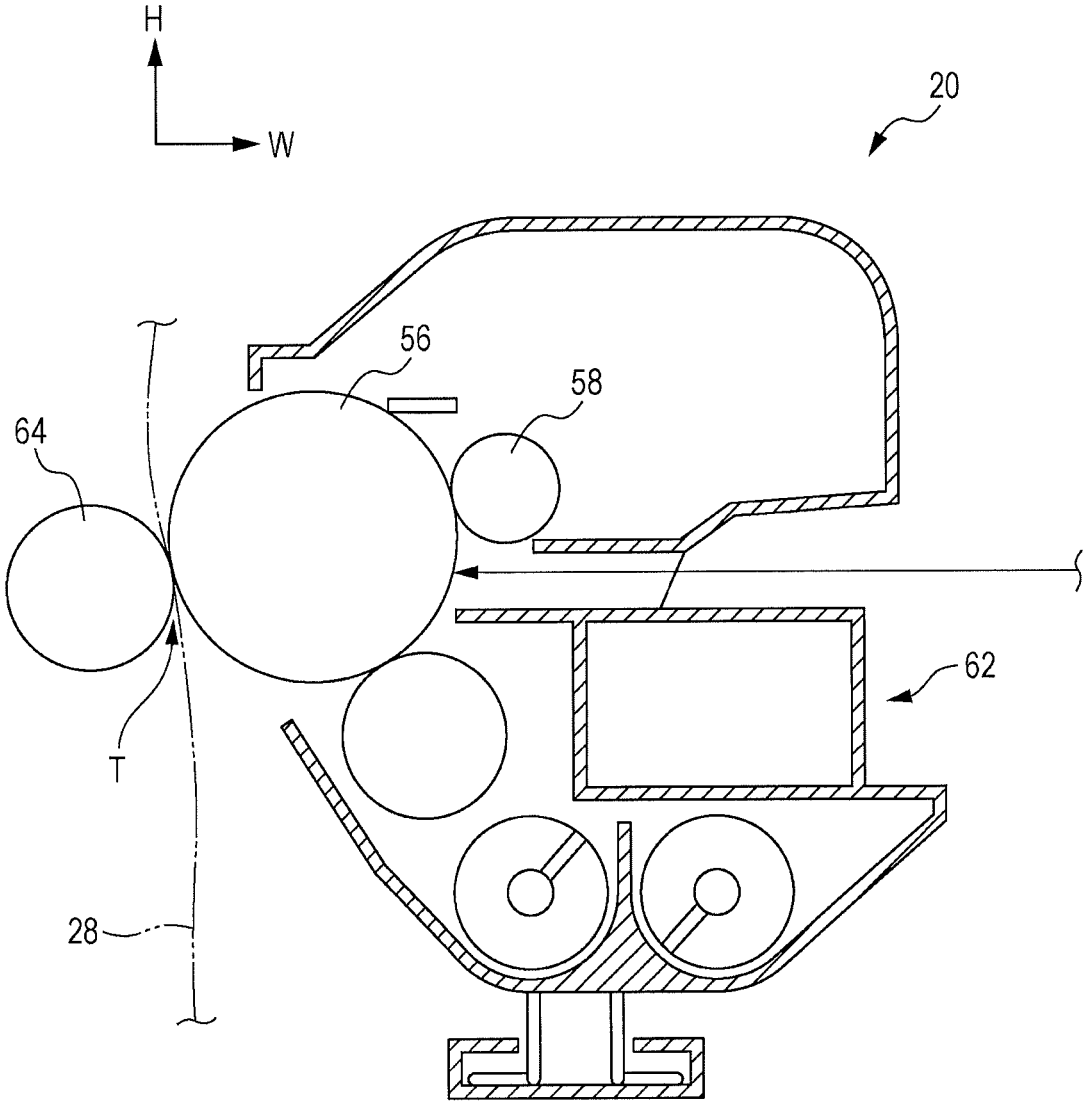
FIG. 5 illustrates the structure of an image forming unit included in an image forming apparatus according to the first exemplary embodiment of the present invention.

As illustrated in FIG. 5, the image forming unit 20 includes an image carrier 56 and a charging roller 58, which is an example of a charging device that charges a surface of the image carrier 56. The image forming unit 20 also includes an exposure device 60 (see FIG. 6) that irradiates the charged surface of the image carrier 56 with light on the basis of image data to form an electrostatic latent image, and a developing device 62 that visualizes the electrostatic latent image by developing the electrostatic latent image into a toner image.

The image forming unit 20 also includes a transfer roller 64 that transfers the toner image formed on the surface of the image carrier 56 onto the sheet material P that is transported along the transport path 28 at a transfer position T at which the transfer roller 64 is in contact with the image carrier 56. The image forming unit 20 also includes a fixing device 66 (see FIG. 6) that fixes the toner image on the sheet material P to the sheet material P by applying heat and pressure.

The image carrier 56, the charging roller 58, etc., will be described in detail below.

Operation of Overall Structure

The image forming apparatus 10 forms an image by the following process.

First, a voltage is applied to the charging roller 58 that is in contact with the surface of the image carrier 56, so that the surface of the image carrier 56 is uniformly charged to a predetermined negative potential. Subsequently, the exposure device 60 irradiates the charged surface of the image carrier 56 with exposure light on the basis of image data read by the document reading unit 22 or data input from an external device, thereby forming an electrostatic latent image.

Thus, the electrostatic latent image corresponding to the image data is formed on the surface of the image carrier 56. The electrostatic latent image is visualized as a toner image by being developed by the developing device 62.

A sheet material P is fed from the container member 26 to the transport path 28 by the feed roller 32, and is transported toward the transfer position T. The sheet material P is transported while being nipped between the image carrier 56 and the transfer roller 64 at the transfer position T, so that the toner image formed on the surface of the image carrier 56 is transferred onto the sheet material P.

The toner image that has been transferred onto the sheet material P is fixed to the sheet material P by the fixing device 66. The sheet material P to which the toner image has been fixed is transported to the outside of the body 10A by the transport rollers 34.

Structure of Components

The image carrier 56, the charging roller 58, etc., will now be described.

Charging Roller

Figure 4:
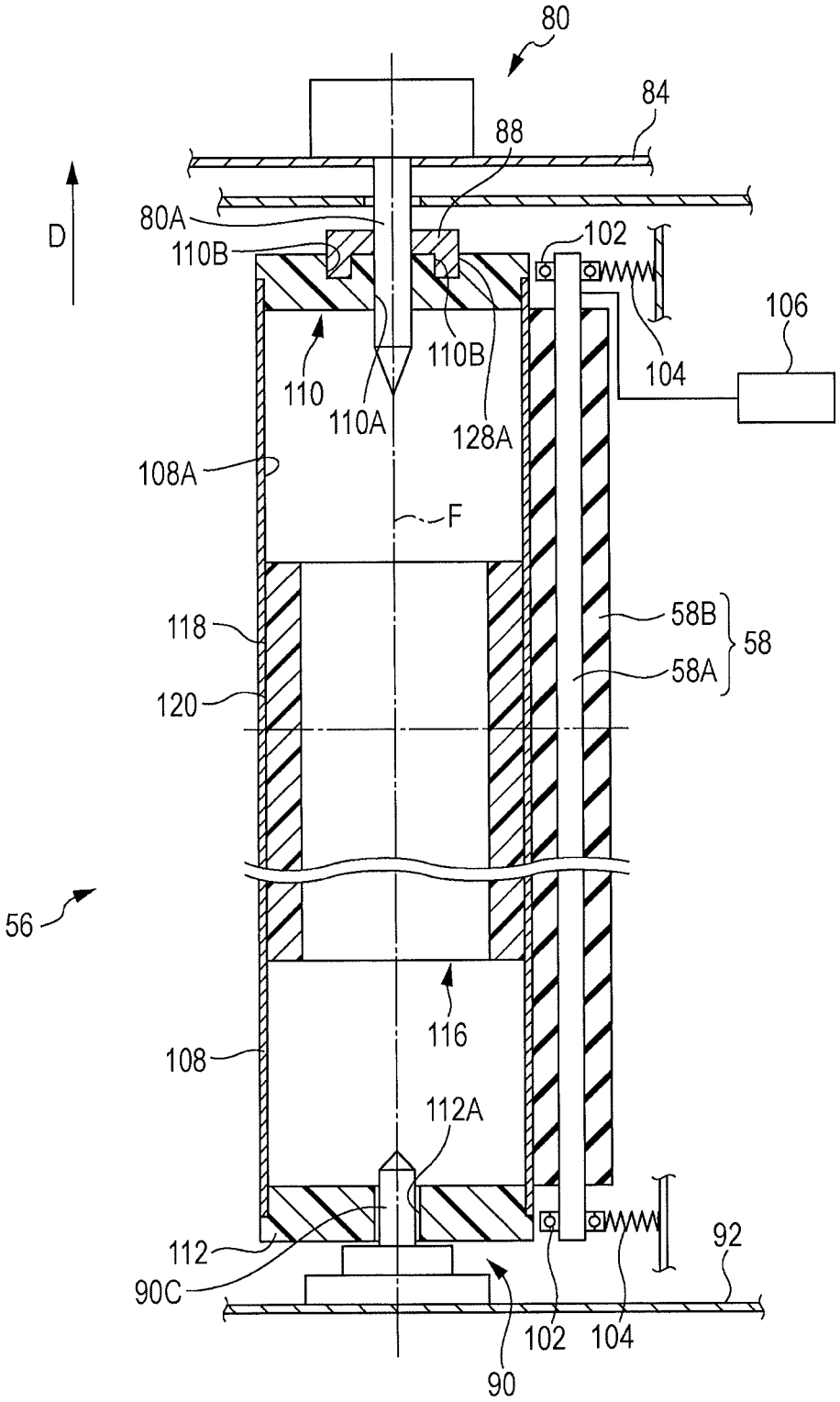
FIG. 4 is a sectional view of an image carrier and other components according to the first exemplary embodiment of the present invention.

As illustrated in FIG. 4, the charging roller 58 includes a shaft 58A that extends in the depth direction of the apparatus and that is made of a metal material (for example, a stainless steel), and a roller portion 58B that has a cylindrical shape through which the shaft 58A extends and that is made of a rubber material.

Both ends of the shaft 58A project outward from the roller portion 58B, and are rotatably supported by a pair of bearings 102. Urging members 104 that urge the bearings 102 toward the image carrier 56 are arranged so as to face the image carrier 56 with the shaft 58A disposed therebetween. With this structure, the roller portion 58B of the charging roller 58 is pressed against the image carrier 56. Accordingly, when the image carrier 56 rotates, the charging roller 58 is rotated by the image carrier 56.

A superposed voltage, in which a direct-current voltage and an alternating-current voltage are superposed, is applied to the shaft 58A by a power supply 106.

Image Carrier

As illustrated in FIG. 4, the image carrier 56 includes a cylinder 108 that has a cylindrical shape and extends in the depth direction of the apparatus, and a transmission member 110 that is fixed to the cylinder 108 at a first end (upper end in FIG. 4) of the cylinder 108 in the depth direction of the apparatus (direction similar to the axial direction of the cylinder 108). The image carrier 56 also includes a base member 112 that is fixed to the cylinder 108 at a second end (lower end in FIG. 4) of the cylinder 108 in the depth direction of the apparatus. The image carrier 56 further includes a support member 116 disposed in the cylinder 108 to suppress periodic deformation (vibration) of the cross sectional shape of the cylinder 108.

The cylinder 108 is formed by forming a photosensitive layer on an outer surface of a cylindrical base made of a metal material. In the present exemplary embodiment, the base of the cylinder 108 is an aluminum tube, and the thickness of the cylinder 108 is 0.8 [mm]. The outer diameter of the cylinder 108 is 23 [mm], and the length of the cylinder 108 in the depth direction of the apparatus is 250 [mm].

The transmission member 110 is made of a resin material and is disc-shaped. A portion of the transmission member 110 is fitted to the cylinder 108 so that the transmission member 110 is fixed to the cylinder 108 and seals the opening of the cylinder 108 at the first end of the cylinder 108. A columnar through hole 110A is formed in the transmission member 110 such that the axis thereof coincides with the axial center F of the cylinder 108. Plural recesses 110B are formed in an outer surface of the transmission member 110 that faces outward in the depth direction of the apparatus. The recesses 110B are positioned such that the through hole 110A is disposed therebetween.

The base member 112 is made of a resin material and is disc-shaped. A portion of the base member 112 is fitted to the cylinder 108 so that the base member 112 is fixed to the cylinder 108 and seals the opening of the cylinder 108 at the second end of the cylinder 108. A columnar through hole 112A is formed in the base member 112 such that the axis thereof coincides with the axial center F of the cylinder 108. The support member 116 will be described in detail below.

Others

As illustrated in FIG. 4, a motor 80 that generates a rotating force to be transmitted to the image carrier 56 (transmission member 110) is disposed near a first end of the image carrier 56 in the depth direction of the apparatus.

The motor 80 is attached to a plate-shaped frame 84. The motor 80 has a motor shaft 80A that extends through the through hole 110A formed in the transmission member 110. A plate-shaped bracket 88 is fixed to the outer peripheral surface of the motor shaft 80A. The bracket 88 has end portions that are bent and inserted into the recesses 110B in the transmission member 110. Thus, the transmission member 110 transmits the rotating force generated by the motor 80 to the cylinder 108.

A stepped columnar shaft member 90 that supports the image carrier 56 (base member 112) in a rotatable manner is disposed at a second end of the image carrier 56 in the depth direction of the apparatus. The shaft member 90 is attached to a plate-shaped frame 92.

The shaft member 90 includes a shaft portion 90C that extends through the columnar through hole 112A of the base member 112 at the axial center F of the cylinder 108. A hollow space is provided between the inner peripheral surface of the columnar through hole 112A and the outer peripheral surface of the shaft portion 90C. Thus, the base member 112 functions as a so-called sliding bearing for the shaft portion 90C.

In this structure, when the motor 80 is activated, the motor shaft 80A rotates. The rotation of the motor shaft 80A is transmitted to the cylinder 108 through the bracket 88 and the transmission member 110 fixed to the first end of the cylinder 108. Accordingly, the base member 112 fixed to the second end of the cylinder 108 rotates around the shaft portion 90C. Thus, the image carrier 56 rotates around the axial center F.

Support Member

The support member 116 supported in the cylinder 108 will now be described.

As illustrated in FIG. 4, the support member 116 is fitted to the cylinder 108 and arranged in a central region of the cylinder 108 in the depth direction of the apparatus. As illustrated in FIG. 2B, an arc-shaped outer peripheral surface 120 of the support member 116 is in contact with an inner peripheral surface 108A of the cylinder 108 and presses the inner peripheral surface 108A, so that the support member 116 is supported by the cylinder 108.

More specifically, the support member 116 is made of an acrylonitrile-butadiene-styrene (ABS) resin, which is a resin material. In the state in which the support member 116 is supported in the cylinder 108, when viewed in the depth direction of the apparatus, the support member 116 is C-shaped (arc-shaped) such that end portions thereof oppose each other along the inner peripheral surface 108A of the cylinder 108. The space between the opposing end portions serve as a separation space 116A that separates the end portions in the circumferential direction. The separation space 116A corresponds to a separation-space-defining portion. In addition, as illustrated in FIG. 3, the support member 116 extends in the depth direction of the apparatus. In the first exemplary embodiment, for example, the thickness of end portions of the support member 116 in the depth direction of the apparatus (thickness T1 in FIG. 2A) is 4 [mm], and the length of the support member 116 in the depth direction of the apparatus is 100 [mm].

As illustrated in FIG. 2B, in the state in which the support member 116 is supported in the cylinder 108, a groove-defining portion 118, which extends in the depth direction of the apparatus, is formed in the outer peripheral surface 120 of the support member 116 at a side opposite to the side at which the separation space 116A is provided with the axial center F of the cylinder 108 provided therebetween.

Figure 2A:
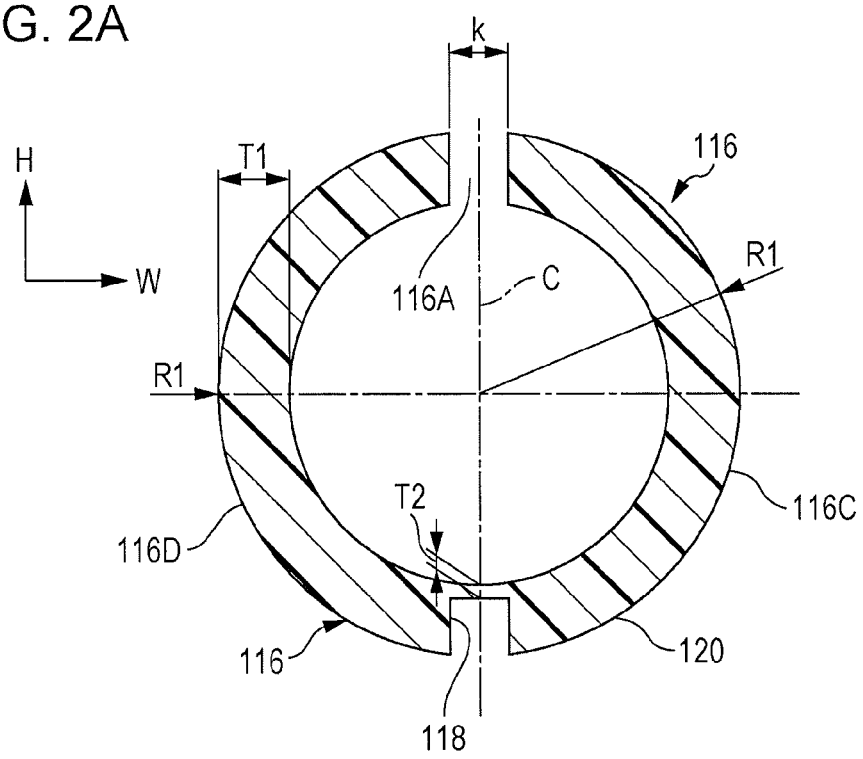
FIGS. 2A and 2B are sectional views of the support member according to the first exemplary embodiment of the present invention.
Figure 2B:
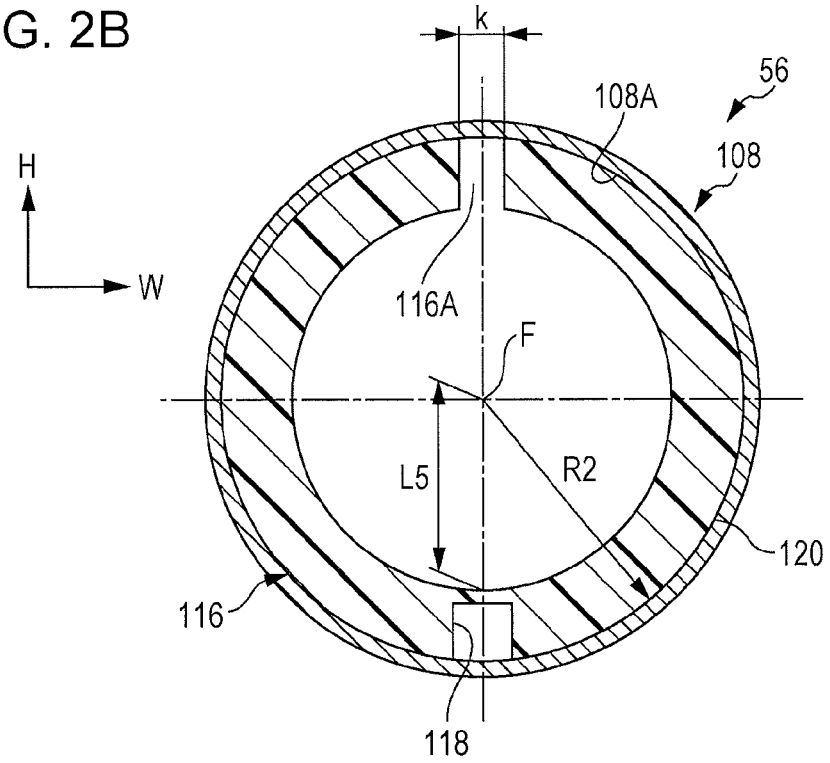
Figure 3:
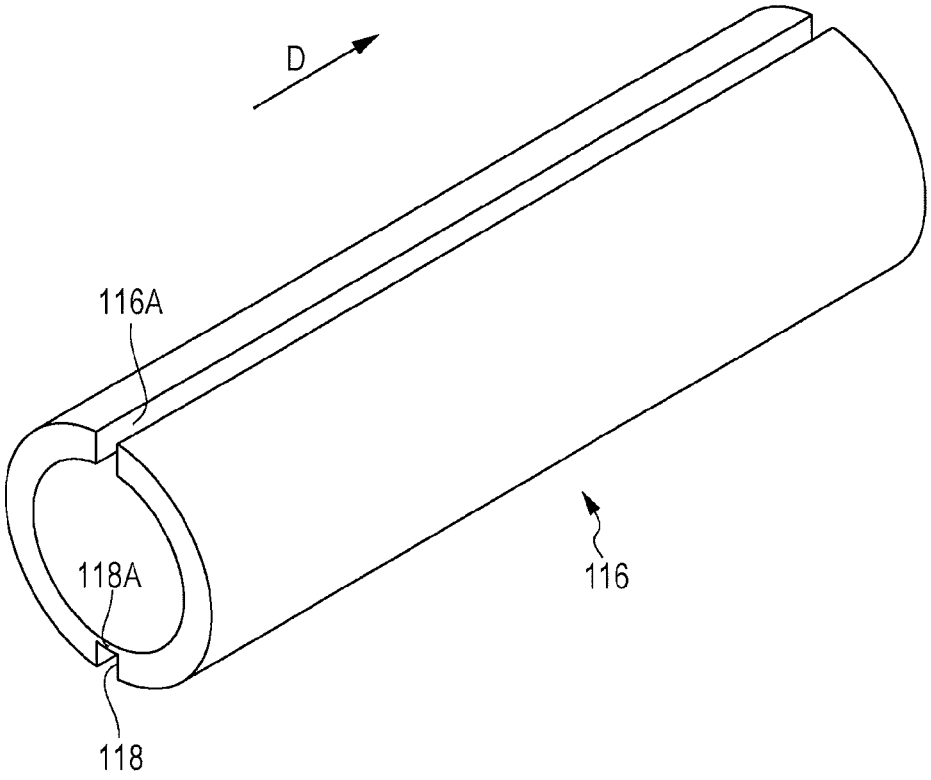
FIG. 3 is a perspective view of the support member according to the first exemplary embodiment of the present invention.

As illustrated in FIG. 2A, in the state in which the support member 116 is not supported in the cylinder 108, that is, when the support member 116 is in a free state, the support member 116 is symmetrical about the axial line C that passes through the separation space 116A and the groove-defining portion 118 when viewed in the depth direction of the apparatus.

More specifically, the support member 116 is shaped such that an arc-shaped portion 116C at the right side in FIG. 2A and an arc-shaped portion 116D at the left side in FIG. 2A are connected together by the groove-defining portion 118. When viewed in the depth direction of the apparatus, the radius R1 of the outer peripheral surface 120 of the arc-shaped portions 116C and 116D of the support member 116 in the free state (see FIG. 2A) is greater than or equal to the radius R2 of the inner peripheral surface 108A of the cylinder 108 (see FIG. 2B).

A gap distance k of the separation space 116A of the support member 116 in the free state (see FIG. 2A) is greater than that in the state in which the support member 116 is supported in the cylinder 108 (see FIG. 2B).

The thickness of a bottom plate 118A of the groove-defining portion 118 (thickness T2 in FIG. 2A) is uniform in the depth direction of the apparatus. In the first exemplary embodiment, the thickness is, for example, 1 [mm]. When the support member 116 is in the free state, the groove-defining portion 118 has a groove depth that varies along the depth direction of the apparatus, as illustrated in FIG. 1B. In other words, in the state in which the support member 116 is supported in the cylinder 108, the distance between the axial center F and the bottom plate 118A (L5 in FIG. 2B) varies along the depth direction of the apparatus.

Figure 1A:
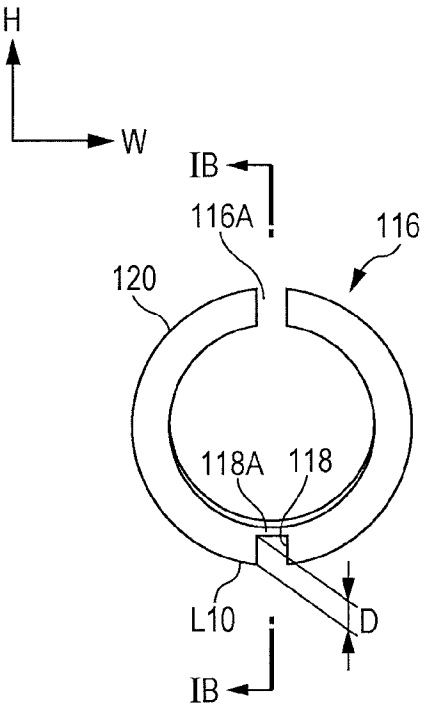
FIG. 1A is a front view of a support member according to a first exemplary embodiment of the present invention.

Here, the groove depth is the distance from the outer peripheral surface 120 to the bottom plate 118A of the groove-defining portion 118, and is denoted by D in FIG. 1A. The groove depth is measured on the assumption that the contour line L10 of the groove-defining portion 118 is linear.

The thickness of the bottom plate 118A is uniform in the depth direction of the apparatus.

More specifically, the bottom plate 118A of the groove-defining portion 118 is bent in the central region in the depth direction of the apparatus. In addition, in cross section perpendicular to the width direction of the apparatus, portions of the bottom plate 118A on one and the other sides of the bent portion J in the depth direction of the apparatus are flat plate-shaped. The groove depth of the groove-defining portion 118 in the central region in the depth direction of the apparatus (groove depth D1 in FIG. 1B) is greater than the groove depth of the groove-defining portion 118 at both ends in the depth direction of the apparatus (groove depth D2 in FIG. 1B). In the first exemplary embodiment, the groove depth D1 is greater than the groove depth D2 by, for example, about 0.2 [mm].

Effects

The effects of the support member 116 in the process of arranging the support member 116 such that the support member 116 is supported in the cylinder 108 will now be described.

To arrange the support member 116 such that the support member 116 is supported in the cylinder 108, the support member 116 is retained such that the bottom plate 118A of the groove-defining portion 118 is elastically deformed so as to reduce the gap distance k. Thus, the support member 116 is bent. The support member 116 retained in the bent state is inserted into the cylinder 108. Then, the retaining force applied to the support member 116 is removed. When the retaining force is removed, the elastically deformed bottom plate 118A exerts an elastic restoring force so that the outer peripheral surface 120 of the support member 116 presses the inner peripheral surface 108A of the cylinder 108. In this state, the support member 116 is pushed toward the central region of the cylinder 108.

Accordingly, as illustrated in FIG. 4, the outer peripheral surface 120 of the support member 116 is in contact with the inner peripheral surface 108A of the cylinder 108 and presses the inner peripheral surface 108A over a region extending in the depth direction of the apparatus (axial direction of the cylinder 108). In this manner, the support member 116 is supported by the cylinder 108.

The effects of the support member 116 will be described from the viewpoint of reduction of vibration of the cylinder 108 due to the support member 116.

To charge the surface of the image carrier 56, the power supply 106 applies a superposed voltage, in which a direct-current voltage and an alternating-current voltage (1 to 2 kHz) are superposed, to the shaft 58A of the charging roller 58 (see FIG. 4). Owing to the alternating-current voltage included in the superposed voltage, an alternating electric field is generated between the charging roller 58 and the image carrier 56. Accordingly, a periodic electrostatic attraction force (2 to 4 kHz) is generated between the image carrier 56 and the charging roller 58. As a result, the cylinder 108 receives a force that periodically changes the cross-sectional shape of the cylinder 108 or vibrates the cylinder 108. However, since the support member 116, which has the outer peripheral surface 120 that presses the inner peripheral surface 108A of the cylinder 108, is supported in the cylinder 108, vibration of the cylinder 108 is reduced even when the force that periodically changes the cross-sectional shape of the cylinder 108 is applied to the cylinder 108.

As the elastic restoring force of the elastically deformed bottom plate 118A increases, the pressing force applied by the outer peripheral surface 120 to the inner peripheral surface 108A of the cylinder 108 increases, and accordingly the vibration of the cylinder 108 is further reduced by the support member 116. In other words, as the thickness of the bottom plate 118A of the groove-defining portion 118 increases, the pressing force applied by the outer peripheral surface 120 to the inner peripheral surface 108A of the cylinder 108 increases, and accordingly the vibration of the cylinder 108 is further reduced.

When the cross-sectional shape of the cylinder 108 periodically changes, the cross-sectional shape of the support member 116 also periodically changes. In the support member 116, strain is concentrated at the bottom plate 118A, which has a thickness smaller than that of other portions. The bottom plate 118A is strained so as to cause internal damping that provides vibration absorption, thereby reducing the vibration of the cylinder 108. In other words, as the thickness of the bottom plate 118A decreases, the strain is more heavily concentrated at the bottom plate 118A and the vibration of the cylinder 108 is further reduced. Accordingly, when the bottom plate 118A has a thickness that is greater than or equal to a predetermined thickness, the strain is not concentrated at the bottom plate 118A and the vibration absorption due to the internal damping does not occur.

The effects of the support member 116 will be further described by comparing the support member 116 with a support member 300 of a comparative example in terms of the pressing force applied by the outer peripheral surface 120 of the support member 116 to the inner peripheral surface 108A of the cylinder 108 and the internal damping caused by the strain of the bottom plate 118A.

First, the support member 300 according to the comparative example will be described. Components of the support member 300 that differ from those of the support member 116 will be mainly described.

Figure 7B:
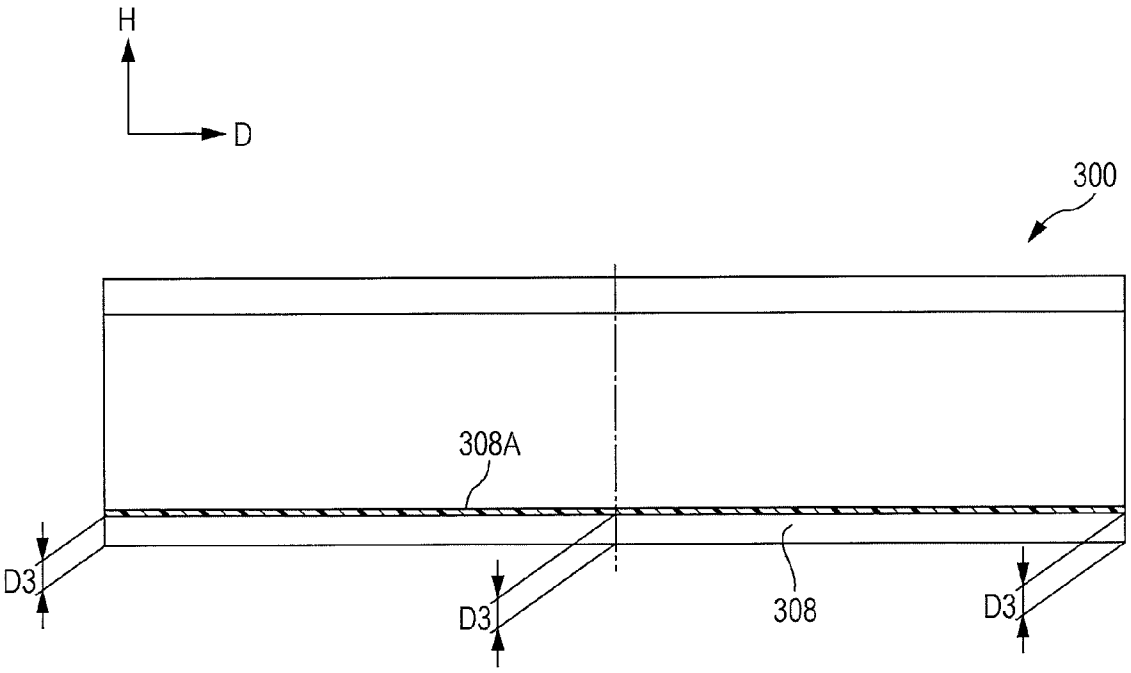
FIG. 7B is a sectional view taken along line VIIB-VIIB in FIG. 7A.
Figure 7A:
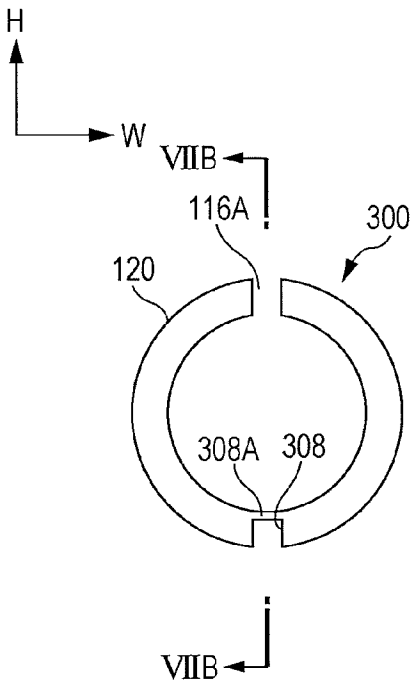
FIG. 7A is a front view of a support member according to a comparative example to be compared with the support member according to the first exemplary embodiment of the present invention.

As illustrated in FIGS. 7A and 7B, the support member 300 has a groove-defining portion 308 having a groove depth (groove depth D3 in FIG. 7B) that does not change along the depth direction of the apparatus. More specifically, the groove depth of the groove-defining portion 308 in the central region in the depth direction of the apparatus is equal to the groove depth of the groove-defining portion 308 at both ends in the depth direction of the apparatus. The groove-defining portion 308 has a bottom plate 308A that is not bent, and the bottom plate 308A is flat plate-shaped in cross section perpendicular to the width direction of the apparatus.

The thickness of the bottom plate 308A of the support member 300 is the same as that of the bottom plate 118A of the support member 116. The groove depth D3 of the groove-defining portion 308 of the support member 300 is constant in the depth direction of the apparatus.

The pressing force applied by the outer peripheral surface 120 to the inner peripheral surface 108A of the cylinder 108 will be described.

As illustrated in FIG. 1B, the groove depth of the groove-defining portion 118 of the support member 116 changes along the depth direction of the apparatus. In other words, the position of the bottom plate 118A of the groove-defining portion 118 in the up-down direction of the apparatus changes along the depth direction of the apparatus.

As illustrated in FIG. 7B, the groove depth of the groove-defining portion 308 of the support member 300 does not change along the depth direction of the apparatus. The bottom plate 308A of the groove-defining portion 308 is flat plate-shaped in cross section perpendicular to the width direction of the apparatus. The thickness of the bottom plate 308A of the groove-defining portion 308 is the same as that of the bottom plate 118A of the groove-defining portion 118.

Accordingly, the second moment of area of the bottom plate 118A is greater than that of the bottom plate 308A, the second moment of area being taken into consideration when the bottom plates 118A and 308A are elastically deformed so as to reduce the gap distance k. Therefore, the elastic restoring force of the bottom plate 118A is greater than that of the bottom plate 308A.

With the above configuration, the pressing force applied by the outer peripheral surface 120 of the support member 116 to the inner peripheral surface 108A of the cylinder 108 is greater than the pressing force applied by the outer peripheral surface 120 of the support member 300 to the inner peripheral surface 108A of the cylinder 108.

Next, the internal damping caused by the strains of the bottom plates 118A and 308A in the area between both ends thereof in the width direction will be described.

As described above, the thickness of the bottom plate 118A of the groove-defining portion 118 of the support member 116 is the same as the thickness of the bottom plate 308A of the groove-defining portion 308 of the support member 300.

Therefore, the internal damping caused by the strain of the bottom plate 118A of the support member 116 is the same as that caused by the strain of the bottom plate 308A of the support member 300. In other words, the amount of reduction in the vibration of the cylinder 108 achieved by vibration absorption due to internal damping caused by the strain of the bottom plate 118A is the same as the amount of reduction in the vibration of the cylinder 108 achieved by vibration absorption due to internal damping caused by the strain of the bottom plate 308A.

Summary

As described above, with the support member 116, the pressing force applied to the inner peripheral surface of the cylinder 108 may be increased from that in the case of the support member 300 while maintaining the vibration absorption due to internal damping.

Since the pressing force applied to the inner peripheral surface 108A of the cylinder 108 is increased, the vibration of the cylinder 108 may be further reduced compared to the case in which the support member 300 is used.

Since the thickness of the bottom plate 118A of the groove-defining portion 118 is not increased, as described above, the amount of reduction in the vibration of the cylinder 108 achieved by vibration absorption due to internal damping caused by the strain of the bottom plate 118A is the same as the amount of reduction in the vibration of the cylinder 108 achieved by vibration absorption due to internal damping caused by the strain of the bottom plate 308A.

When, for example, the support member 116 is formed by injection molding, a sliding mold may be used to form an inner portion of the support member 116. As above-described, the groove-defining portion 118 is formed in the outer peripheral surface 120, and the groove depth of the groove-defining portion 118 in the central region in the depth direction of the apparatus is greater than the groove depth of the groove-defining portion 118 at both ends in the depth direction of the apparatus. The support member 116 may be formed by injection molding by using a sliding mold divided at the center of the sliding mold in the depth direction of the apparatus into mold pieces on one and the other sides in the depth direction of the apparatus.

Since the vibration of the cylinder 108 included in the image carrier 56 is reduced, reduction in the quality of the toner image formed on the image carrier 56 may be suppressed.

Furthermore, since reduction in the quality of the toner image formed on the image carrier 56 is suppressed, reduction in the quality of the image output by the image forming apparatus 10 may be suppressed accordingly.

Second Exemplary Embodiment

A support member, an image carrier, and an image forming apparatus according to a second exemplary embodiment of the present invention will be described with reference to FIGS. 8A and 8B. Components that are the same as those in the first exemplary embodiment are denoted by the same reference numerals, and descriptions thereof are omitted. Components that are different from those in the first exemplary embodiment will be mainly described.

Figure 8B:
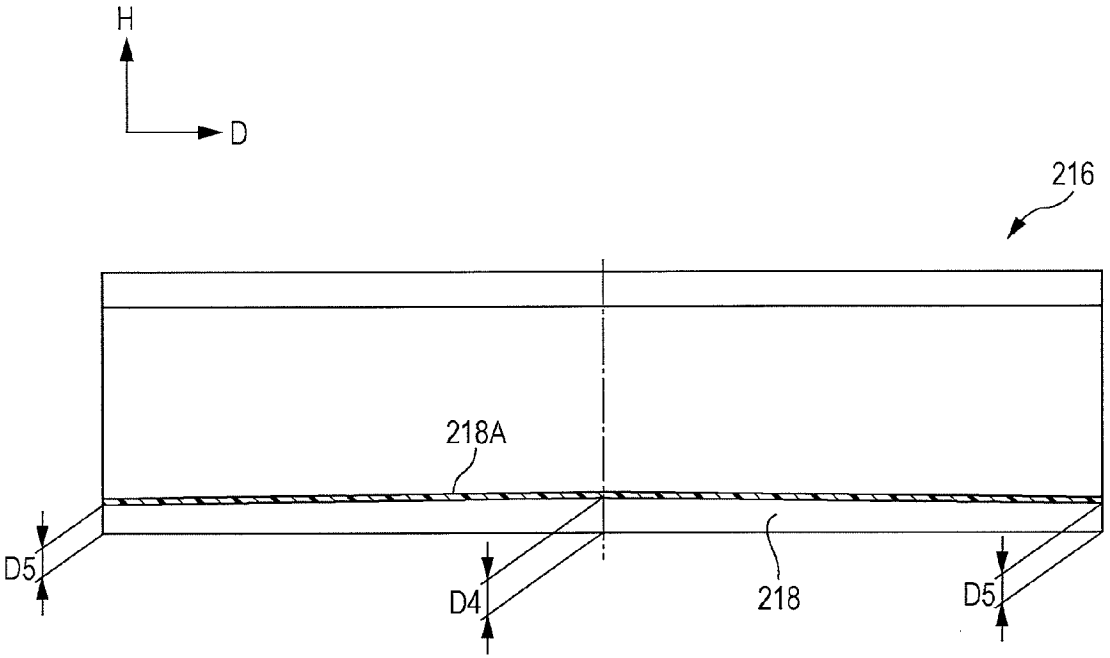
FIG. 8B is a sectional view taken along line VIIIB-VIIIB in FIG. 8A.
Figure 8A:
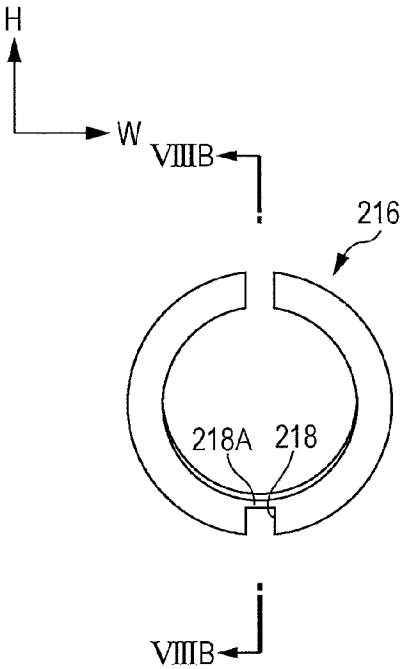
FIG. 8A is a front view of a support member according to a second exemplary embodiment of the present invention.

As illustrated in FIG. 8B, a bottom plate 218A of a groove-defining portion 218 of a support member 216 according to the second exemplary embodiment has a constant thickness in the depth direction of the apparatus. The bottom plate 218A of the groove-defining portion 218 is curved when viewed in width direction of the apparatus so that the groove depth of the groove-defining portion 218 in the central region in the depth direction of the apparatus (D4 in FIG. 8B) is greater than the groove depth of the groove-defining portion 218 at both ends in the depth direction of the apparatus (D5 in FIG. 8B). In the second exemplary embodiment, the groove depth D4 is greater than the groove depth D5 by, for example, about 0.2 [mm].

The effects of the second exemplary embodiment are the same as those of the first exemplary embodiment.

Third Exemplary Embodiment

A support member, an image carrier, and an image forming apparatus according to a third exemplary embodiment of the present invention will be described with reference to FIGS. 9A and 9B. Components that are the same as those in the first exemplary embodiment are denoted by the same reference numerals, and descriptions thereof are omitted. Components that are different from those in the first exemplary embodiment will be mainly described.

Figure 9B:
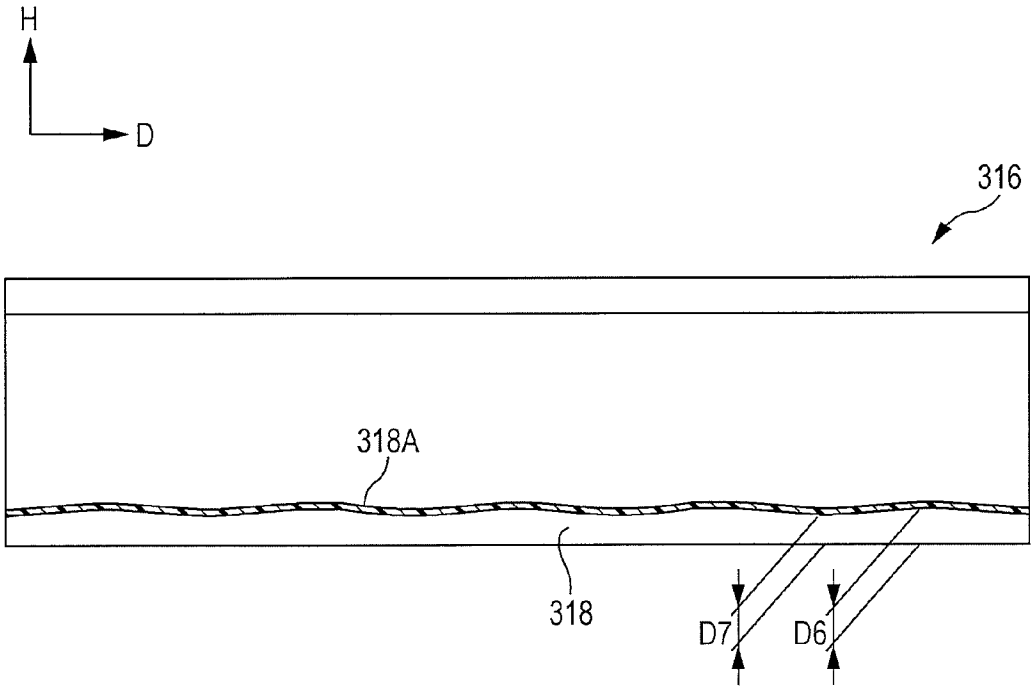
FIG. 9B is a sectional view taken along line IXB-IXB in FIG. 9A.
Figure 9A:
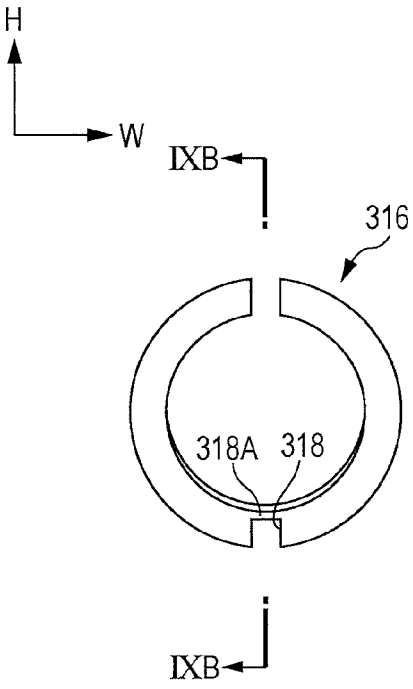
FIG. 9A is a front view of a support member according to a third exemplary embodiment of the present invention.

As illustrated in FIG. 9B, a bottom plate 318A of a groove-defining portion 318 of a support member 316 according to the third exemplary embodiment has a constant thickness in the depth direction of the apparatus. The groove depth of the groove-defining portion 318 periodically increases and decreases along the depth direction of the apparatus.

More specifically, the bottom plate 318A of the groove-defining portion 318 has a zig-zag shape obtained by bending a flat plate in alternate directions in cross section perpendicular to the width direction of the apparatus. In the third exemplary embodiment, the maximum groove depth D6 is greater than the minimum groove depth D7 by, for example, about 0.2 [mm].

Accordingly, the pressing force applied to the inner peripheral surface 108A of the cylinder 108 is greater than that in the case where only the groove depth in the central region of the groove-defining portion is greater than that in other regions as in the first exemplary embodiment. The support member 316 is difficult to form by injection molding. Other effects are the same as those in the first exemplary embodiment.

Fourth Exemplary Embodiment

A support member, an image carrier, and an image forming apparatus according to a fourth exemplary embodiment of the present invention will be described with reference to FIGS. 10A and 10B. Components that are the same as those in the third exemplary embodiment are denoted by the same reference numerals, and descriptions thereof are omitted. Components that are different from those in the third exemplary embodiment will be mainly described.

Figure 10B:
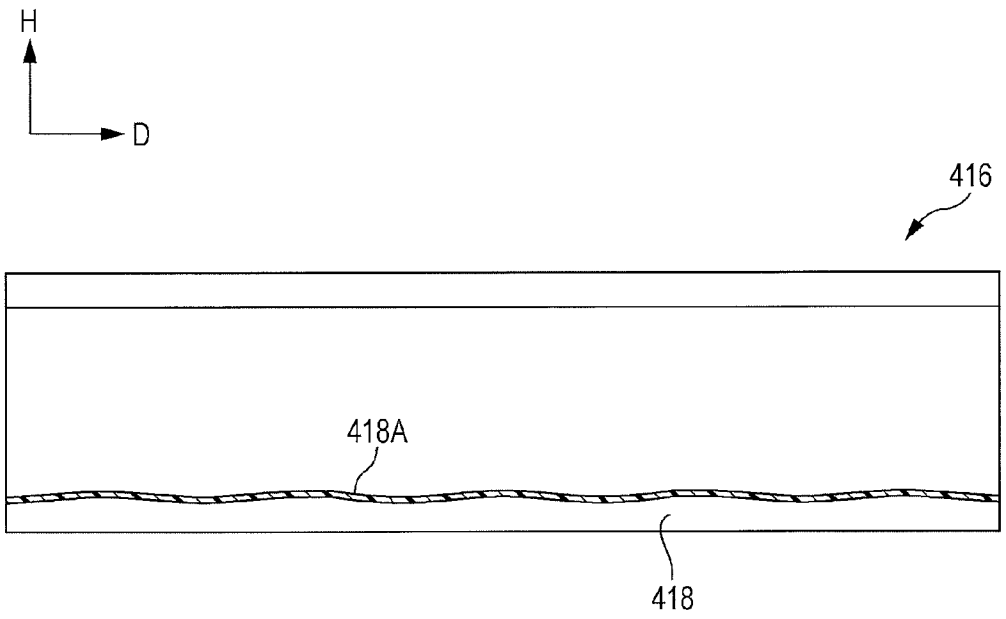
FIG. 10B is a sectional view taken along line XB-XB in FIG. 10A.
Figure 10A:
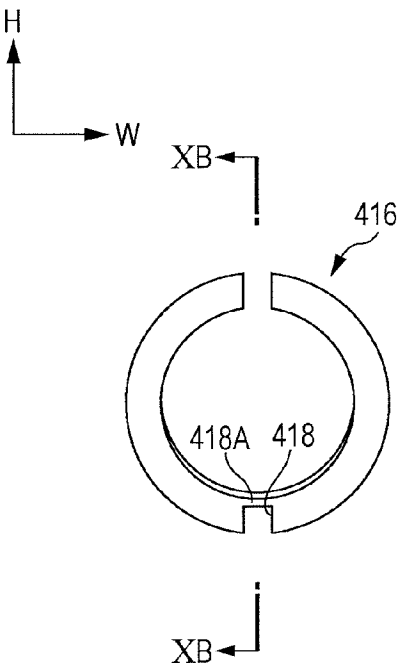
FIG. 10A a front view of a support member according to a fourth exemplary embodiment of the present invention.

As illustrated in FIG. 10B, a groove-defining portion 418 of a support member 416 according to the fourth exemplary embodiment has a groove depth that periodically increases and decreases along the depth direction of the apparatus.

More specifically, a bottom plate 418A of the groove-defining portion 418 has a wavy shape in which concave and convex arcs are continuously arranged in cross section perpendicular to the width direction of the apparatus. The effects of the fourth exemplary embodiment are the same as those of the third exemplary embodiment.

Although specific exemplary embodiments of the present invention have been described in detail, the present invention is not limited to the above-described exemplary embodiments, and it is obvious to a person skilled in the art that various exemplary embodiments are possible within the scope of the present invention. For example, although the groove-defining portions 118, 218, 318 and 418 are formed in the outer peripheral surfaces 120 of the support members 116, 216, 316, and 416 in the above-described exemplary embodiments, they may instead be formed in the inner peripheral surfaces.

In addition, in the above-described exemplary embodiments, the outer peripheral surface 120 of each of the support members 116, 216, 316 and 416 presses the inner peripheral surface 108A of the cylinder 108 over a region extending in the depth direction of the apparatus. However, each of the support members 116, 216, 316 and 416 is not limited to this as long as the outer peripheral surface 120 thereof presses the inner peripheral surface 108A of the cylinder 108 at least at both ends thereof in the depth direction of the apparatus.

Although a single support member 116, 216, 316, or 416 is supported in the cylinder 108 in the above-described exemplary embodiments, two or more support members may instead be supported.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A support member supported in a cylinder included in an image carrier, the support member comprising:

a slot that is arranged at a certain position in a circumferential direction and extends along the entire length of the support member in an axial direction of the cylinder and the support member has a cylindrical shape; and a groove-defining portion having a groove depth that changes along the axial direction, wherein a bottom plate of the groove-defining portion is elastically deformed so that the support member presses an inner peripheral surface of the cylinder and is thereby supported in the cylinder.

2. The support member according to claim 1, wherein the groove-defining portion is formed on an outer peripheral surface of the support member, and wherein the groove depth in a central region in the axial direction is greater than the groove depth at both ends in the axial direction.

3. An image carrier comprising:

a cylinder that has a cylindrical shape and on whose surface a toner image is formed; and the support member according to claim 2 that is supported in the cylinder.

4. An image forming apparatus comprising:

the image carrier according to claim 3;

a charging device that charges the image carrier;

an exposure device that irradiates the charged image carrier with light to form an electrostatic latent image;

a developing device that develops the electrostatic latent image formed on a surface of the image carrier into a toner image; and a transfer device that transfers the toner image formed on the surface of the image carrier onto a recording medium.

5. The support member according to claim 1, wherein the groove-defining portion is formed on an outer peripheral surface of the support member, and wherein the groove depth repeatedly increases and decreases along the axial direction.

6. An image carrier comprising:

a cylinder that has a cylindrical shape and on whose surface a toner image is formed; and the support member according to claim 5 that is supported in the cylinder.

7. An image forming apparatus comprising:

the image carrier according to claim 6;

a charging device that charges the image carrier;

an exposure device that irradiates the charged image carrier with light to form an electrostatic latent image;

a developing device that develops the electrostatic latent image formed on a surface of the image carrier into a toner image; and a transfer device that transfers the toner image formed on the surface of the image carrier onto a recording medium.

8. An image carrier comprising:

the support member according to claim 1 that is supported in the cylinder, wherein the cylinder has a cylindrical shape and on whose surface a toner image is formed.

9. An image forming apparatus comprising:

the image carrier according to claim 8;

a charging device that charges the image carrier;

an exposure device that irradiates the charged image carrier with light to form an electrostatic latent image;

a developing device that develops the electrostatic latent image formed on a surface of the image carrier into a toner image; and a transfer device that transfers the toner image formed on the surface of the image carrier onto a recording medium.

* * * * *